United States Patent [19]

Spadini et al.

[11] 3,983,079

[45] Sept. 28, 1976

[54] DISHWASHING COMPOSITION

[75] Inventors: Gianfranco Luigi Spadini, Strombeek-Bever; Emiel Mathilde Anna Alfons Demessemaekers, Heverlee, both of Belgium

[73] Assignee: The Procter & Gamble Company, Cincinnati, Ohio

[22] Filed: Aug. 29, 1974

[21] Appl. No.: 501,531

[30] Foreign Application Priority Data

Sept. 4, 1973 Luxemburg ..... 68355

[52] U.S. Cl. ..... 252/545; 252/546; 252/547; 252/DIG. 1; 252/DIG. 10

[51] Int. Cl.[2] ..... C11D 1/62; C11D 1/65

[58] Field of Search ..... 252/545, DIG. 10, 547, 252/DIG. 1, 546

[56] References Cited

UNITED STATES PATENTS

| | | | |
|---|---|---|---|
| 2,113,606 | 4/1938 | Taub et al. | 260/501.15 |
| 2,702,279 | 2/1955 | Funderburk et al. | 252/546 |
| 3,360,470 | 12/1967 | Wixon | 252/547 X |
| 3,733,277 | 5/1973 | Wooden et al. | 252/DIG. 10 |

*Primary Examiner*—Thomas J. Herbert, Jr.
*Attorney, Agent, or Firm*—Forrest L. Collins; Edmund F. Gebhardt; Thomas H. O'Flaherty

[57] ABSTRACT

A granular, agglomerated, powdered or liquid detergent composition comprising a surface-active quaternary ammonium compound, a slightly water-soluble nonionic polypropylene oxide-polyethylene oxide condensation product, and either a surface-active betaine or a sultaine. The detergent composition is designed particularly for washing glassware, china, and glazed or vitreous articles. It provides not only good cleaning, especially fat removal and suspension, but also imparts to the washed articles persistent rinse water drainage characteristics which substantially minimize the filming, streaking, spotting of the washed, rinsed and air-dried articles.

8 Claims, No Drawings

DISHWASHING COMPOSITION

BACKGROUND OF THE INVENTION

1. Field of the Invention

This invention relates to detergent compositions containing quaternary ammonium compounds.

2. Description of the Prior Art

The performance of a detergent composition in cleaning glasses, dishes, windows and other articles with glazed surfaces is usually evaluated by the consumer in terms of shine, non-filming, non-spotting, non-streaking. The detergent compositions presently on the market are mainly designed to remove soils from these glasses, windows and dishes. The detergent solution and redeposited soil residues then have to be removed from the washed articles by rinsing and then towelling the articles while they are still wet. If the washed articles are not rinsed and towel-dried immediately, the residues dry upon the surfaces of the washed articles, leaving hard-to-remove spots, film or streaks. Additionally, if the articles are rinsed in plain water and are not towel-dried immediately, water hardness spots and streaks appear on the washed and rinsed surfaces upon evaporation of the water.

Towel-drying of washed articles such as glasses and dishes immediately after they are removed from the washing and rinsing liquors is uneconomic (towels are required) and is not always possible (too frequent interruptions of the washing). Therefore, many consumers simply put the washed or washed and rinsed articles aside for draining and air-drying. Consequently, the cleaning efficiency of the product used, which the consumer may have visually appreciated at the end of the washing or rinsing cycle, is lost because of the dried, hard-to-remove, unpleasant, adhering, redeposited detergent, soil, and water hardness residues of the washing and rinsing liquors.

The cleaning of larger glazed surfaces such as tiled walls, ceramic bath tubs, wash-basins or other similar items having a vitreous surface, also requires wiping or rinsing and wiping while the surfaces are still wet to avoid spotting, filming and streaking. Wiping immediately after cleaning to avoid evaporation and, consequently, spotting, streaking and filming, is not always feasible and requires frequent interruption of the cleaning process. Therefore, detergent compositions may be considered by consumers as being ineffective although the soil may have been removed in the first instance because of the streaks, film and spots left on the washed surfaces.

Attempts have been made to minimize the effect of detergent, soil, and water hardness residue deposition during air-drying by employing various additives at either the washing or rinsing stage of the cleaning cycle. Commonly, water hardness complexing agents or improved soil suspending agents are added to the detergent compositions; special rinsing agents are sometimes formulated. Incorporating complexing or soil suspending agents in liquid detergent compositions creates formulation difficulties, while special rinsing agents have to be packed and applied separately.

Detergent compositions containing a betaine and a nonionic condensation product of one mole of a fatty alcohol and 0.2 to 3 moles ethylene oxide are disclosed in the U.S. Pat. No. 2,702,279 issued to Funderburk and Hurka on Feb. 15, 1955. Said nonionic condensation product is said to increase and stabilize the foam produced by the betaine in aqueous solutions containing greasy soil. Dishes and glasses washed with said compositions do not show any drainage effect after rinsing. Thus, said compositions are not suitable for washing, followed by air-drying.

SUMMARY OF THE INVENTION

It has now been surprisingly found that a particular combination comprising three surface-active compounds of dissimilar natures (a water-soluble surface-active quaternary ammonium compound, a slightly water-soluble polypropylene oxide- polyethylene oxide condensation product, and a betaine or sultaine) yields an outstanding washing and cleaning agent which foams copiously, has excellent grease removal and grease suspension properties, and is particularly suitable for cleaning glassware, china, glazed or vitreous articles. This combination imparts regular, persistent drainage characteristics to the washed articles thereby eliminating the need for towel-drying and substantially minimizes filming, streaking, and spotting of the washed, cleaned, rinsed and air-dried glassware, china and glazed or vitreous articles and imparts improved lustre and shine to the washed and rinsed articles with less effort by the consumer.

DETAILED DESCRIPTION OF THE INVENTION

The detergent composition of this invention, which is especially adapted for washing and imparting shine to glassware, china and other vitreous articles and simultaneously providing persistent, regular drainage characteristics, thereby making towel-drying or wiping or additional special rinsing and heating cycles in dishwashing machines superfluous, comprises, calculated on the total weight of the composition:

A. from about 0.5 to about 10% by weight of a water-soluble quaternary ammonium compound of the general formula

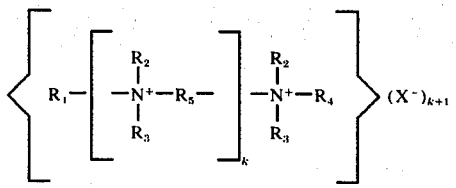

wherein $R_1$ represents a radical selected from the group consisting of aliphatic hydrocarbon radicals optionally interrupted by an oxygen atom or —CONH— group, having in total from about 8 to about 22 carbon atoms, alkylaryl radicals having from about 8 to about 16 carbon atoms in the alkyl moiety, alkyl radicals having from about 8 to about 16 carbon atoms, and aryl; $R_2$ and $R_3$ represent radicals selected from the group consisting of methyl, ethyl, propyl, hydroxyethyl, and hydroxypropyl; $R_4$ represents an aliphatic hydrocarbon radical having from 1 to about 22, preferably about 8 to about 22 carbon atoms, said hydrocarbon radical optionally interrupted by an oxygen or —CONH— group; $R_5$ represents a radical selected from the group consisting of ethylene, propylene, and hydroxypropylene; $k$ is 0,1 or 2; and $X^-$ is an anion, preferably $Cl^-$, $Br^-$, or $CH_3SO_3^-$;

B. from about 1 to about 30 percent by weight of a nonionic surface active polypropylene oxide-polyethylene oxide condensation product, having a molecular weight of from about 500 to about 10,000, preferably of from 1,000 to 5,000, and wherein the ethylene oxide content, calculated on the total weight of the condensation product, is from about 10 to about 30 percent by weight;

C. from about 2 to about 50 percent by weight of a water-soluble betaine or sultaine of the general formula:

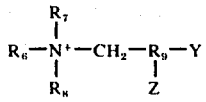

wherein $R_6$ represents a radical selected from the group consisting of aliphatic hydrocarbon, optionally interrupted by an oxygen or —CONH— group, having in total from about 8 to about 22 carbon atoms, alkylaryl having from about 8 to about 16 carbon atoms in the alkyl moiety, and arylalkyl having from about 8 to about 16 carbon atoms in the alkyl moiety; $R_7$ and $R_8$ represent radicals selected from the group consisting of methyl, ethyl, propyl, hydroxyethyl and hydroxypropyl; $Y^-$ is selected from the group consisting of $—COO^-$ and $—SO_3^-$; $R_9$ represents a chemical bond or an alkylene radical having from 1 to about 5 carbon atoms; and Z represents a hydrogen atom, or a hydroxyl or methyl group substituted in the 2-position relative to Y; whereby the weight ratio of (A)/(B) is from about 1:2 to about 1:20, and the weight ratio of (A)/(C) is from about 1:4 to about 1:50.

Thus, the detergent composition of the present invention contains three essential components: a water-soluble, surface-active, quaternary ammonium compound, a slightly water-soluble nonionic surface-active condensation product, and a betaine or sultaine. The composition can additionally contain a neutral carrier and other optional detergent composition adjuvants. Each of the aspects of the present invention is discussed in detail below.

The first essential component of the detergent composition of the present invention is a water-soluble quaternary ammonium compound of the general formula

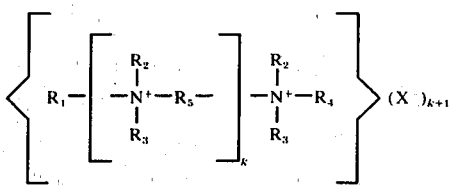

wherein $R_1$, $R_2$, $R_3$, $R_4$, $R_5$, K and X have the meaning given above.

Specific examples of compounds having two quaternary ammonium groups, and two long aliphatic hydrocarbon radicals are represented by the formula:

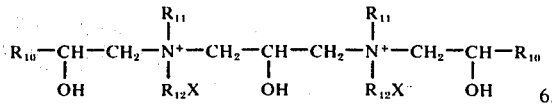

wherein $R_{10}$ is an alkyl radical containing from 6 to about 20, preferably 10 to 14, carbon atoms, and $R_{11}$ and $R_{12}$ are methyl, ethyl or hydroxyethyl, and the cation $X^-$ is a chloride or bromide. Specific compounds are: tetramethyl-di-(octoxy-β-hydroxypropyl)-β-hydroxypropylene-diammonium chloride, tetramethyl-di-(β-hydroxydodecyl)-β-hydroxypropylene-diammonium bromide, tetramethyl-di-(β-hydroxytetradecyl)-β-hydroxypropylene-diammonium chloride, tetraethyl-di-(dodecyloxy-β-hydroxypropyl)-β-hydroxy-propylene-diammonium chloride.

The diquaternary ammonium compounds useful in the composition of this invention can be obtained by several methods known to those skilled in the art. In Example 7 of the U.S. Pat. No. 2,113,606 issued to Ludwig Taub et al on April 12, 1938, a preparation of one of the specific compounds is disclosed. Others can be made by analogous methods.

Specific surface-active ammonium compounds with one quaternary ammonium group, which are preferred in liquid detergent compositions of the present invention, are: ditallow-dimethylammonium chloride, didecyldimethylammonium chloride, ditetradecyl-diethyl ammonium bromide, dioctoxymethyl-dimethyl ammonium methyl sulfonate $[(C_8H_{17}OCH_2)_2(CH_3)_2N^+.CH_3SO_3^-]$, di(β-hydroxydodecyl)-dimethylammonium chloride, tetradecyl-octyl-dimethylammonium bromide, (dodecoxy-β-hydroxypropyl)-trimethyl ammonium chloride, octadecyl-tri-(hydroxyethyl)-ammonium bromide, octylphenoxyethyl-dihydroxyethyl-methyl ammonium bromide $[C_8H_{17}C_6H_4OC_2H_4N^+CH_3(C_2H_4OH)_2.Br]$, and lauryl-1,3-amidopropyl-triethylammonium chloride $[C_{11}H_{23}CONHC_3H_6N^+(C_2H_5)_3Cl^-]$. Said quaternary ammonium compounds can be made according to different method known to those skilled in the art.

The amount of quaternary ammonium compound present in the composition of the present invention may vary between from about 0.5 to about 10 percent by weight, preferably between 1 and 5 percent by weight, calculated on the total weight of the composition. If the very low level of 0.5 percent by weight of quaternary ammonium compounds is necessary to obtain a noticeable drainage effect, a minimum level of about 1 percent by weight is preferred, particularly in liquid detergent compositions. The upper level is restricted to about 10 percent by weight because no additional benefit is obtained beyond this level and, in addition, because of formulation requirements especially when the quaternary ammonium compound has two long hydrophobic radicals each containing more than 12 carbon atoms.

Liquid compositions of the present invention preferably contain from about 1 to about 3 percent of the quaternary ammonium compound while powdered compositions preferably contain from about 1 to about 5 percent by weight of the compound.

The second essential component of the detergent composition is a polypropylene oxide-polyethylene oxide condensation product which is slightly soluble in water and wherein the total ethylene oxide content of the condensation product is from about 10 to about 30 percent by weight of the total weight of the condensation product and wherein the total molecular weight is from about 500 to about 10,000, preferably from about 1,000 to about 5,000. Condensation products which have a low ethylene oxide content, e.g. 10–15 percent by weight, should preferably have a molecular weight from about 500 to about 2,500 while condensation products with a high ethylene oxide content should have a high molecular weight.

The polypropylene oxide-polyethylene oxide condensation products appear to have a high influence on the regularity of the drainage of the rinse water. Too high a speed of drainage of the rinse water causes breakages in the film of rinse water draining from the washed and rinsed articles leaving drops of rinsing water on the surface of said articles which form hard-to-remove spots because of precipitated water hardness salts. Therefore, the film of rinse water should drain off regularly, but not slowly. To obtain fast but regular drainage, the amount of polypropylene oxide-polyethylene oxide condensation product present in the compositions of the present invention should be at least about 2 times the amount of quaternary ammonium compound, and preferably about 4 times that amount. While the amount of condensation product present may be as much as about 20 times the amount of quaternary ammonium compound present, it is preferred to restrict it to about 10 times the amount of quaternary ammonium compound. The total amount of condensation product in the composition of the present invention should not exceed about 30 percent by weight of the total weight of the composition, and should preferably be below about 20 percent by weight. It is surprising that only the condensation products as defined hereinbefore impart fast, regular drainage to compositions of the present invention, while other nonionic condensation products, obtained for example by reacting a fatty alcohol or a $C_{6-12}$alkylphenol with ethylene oxide, which have about the same molecular weight and percentage by weight of ethylene oxide as the condensation products of this invention, do not provide the effect.

Since the weight of the ethylene oxide units or moieties present in the condensation product and not the distribution of said ethylene oxide units in the product is of primary importance to obtain a fast, regular drainage, said condensation product can be manufactured by many methods well known to those skilled in the art.

The third essential component of the composition of the present invention is a betaine or sultaine having the general formula:

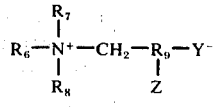

wherein $R_6$, $R_7$, $R_8$, $R_9$, Z and $Y^-$ have the meaning given above. Although mixtures of betaines and sultaines can be used, particularly in very low amounts, preferred are compositions containing either betaine or sultaine, most preferably sultaine.

Specific examples of sultaines of particular interest are those in which $R_6$ is a single alkyl of from about 10 to about 18 carbon atoms or mixtures of alkyl chains derived from naturally occurring substances, hydrogenated and nonhydrogenated, and wherein the $R_7$ and $R_8$ are methyl, ethyl, or hydroxyethyl radicals. Other specific examples of the sultaines include: 3-(N,N-dimethyl-N-hexadecylammonio)-propane-1-sulfonate, 2-(N,N-dimethyl-N-dodecylammonio)-ethane-1-sulfonate, 4-(N,N-diethyl-N-tetradecylammonio)-butate-1-sulfonate, 4-[N,N-di(2-hydroxyethyl)-N-octadecylammonio]-2-hydroxybutane-1-sulfonate, 2-[N,N-di(2-hydroxyethyl)-N-dodecylammonio]-ethane-1-sulfonate, 4-[N-methyl-N-(2-hydroxyethyl)-N-hexadecylammonio]-3-hydroxybutane-1-sulfonate, 3-(N,N-dimethyl-N-hexadecylammonio)-2-hydroxypropane-1-sulfonate.

Other specific examples include compounds wherein long alkyl chains are used to provide the corresponding octyl, decyl, dodecyl, tetradecyl, hexadecyl, octadecyl homologues of the above compounds such as 3-(N,N-dimethyl-N-tetradecylammonio)-propane-1-sulfonate, etc. Still other specific examples include compounds in which the short chains substituted on the nitrogen atoms in the above compounds are replaced by methyl, ethyl and hydroxyethyl groups to provide the corresponding homologues of the above compounds. Another series of specific examples includes compounds wherein alkylaryl and arylalkyl radicals are present as long hydrophobic hydrocarbon radical, such as 3(N-decylbenzyl-N,N-dimethylammonio)-2-hydroxypropane-1-sulfonate; 2-(N-tetradecylbenzyl-N,N-diethylammonio)-ethane-1-sulfonate; and 3-[N-benzyl-dodecyl-N,N-(2-hydroxyethyl)ammonio]-propane-1-sulfonate.

Said sultaines can be made according to different processes known to those skilled in the art. Specific processes are described, for example, in the German patent specification DBP 1,018,421, the U.S. Pat. Nos. 2,129,264, 3,360,470 (Example I), and 3,239,560.

Specific examples of betaines of particular interest are those in which the $R_6$ is a single alkyl of from about 10 to about 18 carbon atoms or mixtures of alkyl chains derived from naturally occurring substances, hydrogenated or unhydrogenated, particularly from coconut oil, and wherein $R_7$ and $R_8$ are methyl, ethyl or hydroxyethyl radicals. Other specific examples of said betaines include: 3-(N,N-dimethyl-N-dodecylammonio)-propionate-1 ($C_{12}H_{25}N^+(CH_3)_2.C_2H_4COO^-$), 4-(N,N-diethyl-N-tetradecylammonio)butanate-1, 3-[N,N-di(2-hydroxyethyl)-N-octadecyl]-2-hydroxypropionate-1, and N,N-dimethyltetradecylammonio acetate ($C_{14}H_{29}N^+(CH_3)_2CH_2COO^-$). Another specific example is octylphenoxyethyl-di(hydroxyethyl) ammonio acetate: $C_8H_{17}C_6H_4OC_2H_4N^+(C_2H_4OH)_2.CH_2COO^-$.

The amount of sultaine or betaine present in the composition of the present invention may vary from about 2 to about 50 percent by weight, preferably from about 4 to about 20 percent by weight. The amount of sultaine or betaine in the composition of the present invention should be at least four times the weight of quaternary ammonium compound. Amounts beyond 50 times the weight of the quaternary ammonium compound are acceptable, but are not needed and restrict the ease of formulation. Preferred weight ratios of quaternary ammonium compound to sultaine or betaine are from about 1:5 to about 1:20. At these preferred ratios, one of the most persistent, fast and regular drainages is obtained, one which permits the user to leave the washed dishes in the rinsing bath for up to 20 minutes, thereby giving a great flexibility to the washing job.

The sultaine or betaine not only imparts cleaning power to the composition, but also surprisingly imparts persistency to the fast and regular drainage effect. This is the more surprising since chemically very similar compounds such as taurides having approximately the same molecular weight and long chain and short chain substituents do not impart persistency to the drainage and even adversely influence the speed and regularity of the drainage phenomenon. The same is true for quaternary ammonium sulfonates and quaternary ammonium alkylsulfates. Since one of the most specific differences between the quaternary ammonium sulfonates and sultaines is the intromolecular binding of the latter, it could be assumed that other amphoteric compounds would yield the same properties as said betaines or sultaines. But well known amphoterics as described for example in U.S. Pat. No. 2,528,378 issued to Mannheimer on Oct. 31, 1950 do not impart persistency to the drainage phenomenon either. Thus, the effect obtained by the sultaine or betaine is quite specific.

A preferred optional neutral carrier is water. In the formulation of granular, powdered and agglomerated compositions of the present invention, suitable neutral carriers are sodium sulfate and potassium sulfate. Sodium silicate, sodium chloride and potassium chloride can be added. Optional neutral carriers can be present in amounts up to about 90 percent by weight of the total composition, but should preferably not exceed about 75 percent by weight. Most preferably the composition in liquid form contains at least 15 percent by weight of the ternary mixture of essential surface-active agents and at least 35 percent by weight when in granular, powdered, or agglomerated form.

The attractivity, efficacity and economy of the composition of the present invention can be tailored to suit specific needs, and adapted or improved by admixing additional nonionic surface-active detergents, organic acids and salts, inorganic builder salts, emulsifying agents, bactericides, dyes, perfumes, corrosion inhibitors, and soil suspending agents, as more specifically defined hereinafter.

Suitable water-soluble nonionic surfactants can optionally be added to the composition of the present invention in amounts not exceeding the total weight of the three essential components, preferably less than about 50 percent by weight of the three components. Examples of suitable optional nonionic surfactants include:

1. Tertiary amine oxides represented by the general formula $$R_{13}R_{14}R_{15}N \rightarrow O$$

wherein $R_{13}$ represents a high molecular weight, straight or branched chain, saturated or unsaturated aliphatic hydrocarbon, hydroxyhydrocarbon, or alkyloxyhydrocarbon radical, preferably an alkyl radical having from 8 to 24, preferably from 12 to 16 carbon atoms; $R_{14}$ and $R_{15}$ each represent a methyl, ethyl, hydroxymethyl or hydroxyethyl radical. Amine oxides are generally prepared by direct oxidation of appropriate tertiary amines according to known methods. Specific examples of tertiary amine oxides are: dimethyl dodecyl amine oxide; diethyl tetradecyl amine oxide; bis-(2-hydroxyethyl)-dodecyl amine oxide; bis-(2-hydroxyethyl)-3-dodecoxy-1-hydroxypropyl amine oxide; dimethyl 2-hydroxy-dodecyl amine oxide; and diethyl eicosyl amine oxide.

2. Water-soluble amides represented by the general formula $$R_{16}\text{-CO-N(H)}_{m-1}(R_{17}OH)_{3-m}$$

wherein $R_{16}$ is a saturated or unsaturated aliphatic hydrocarbon radical having from 7 to 21, preferably from 11 to 17 carbon atoms; $R_{17}$ represents a methylene or ethylene group; and m is 1, 2, or 3, preferably 1. Specific examples of said amides are mono-ethanol coconut fatty acids amide, diethanol dodecyl fatty acid amide, and dimethanol oleyl amide.

3. Water-soluble condensation products obtained by condensing, in a manner known per se, from about 3 to about 25 moles ethylene oxide with one mole of an organic, hydrophobic compound which may be either aliphatic or alkyl aromatic in nature, having 8 to 24 carbon atoms and at least one reactive hydrogen atom or, preferably, a reactive hydroxyl, amino, amido, or carboxy group. General examples are:

a. The condensates of ethylene oxide with aliphatic alcohols of more than eight carbon atoms. The alcohols can be derived not only from naturally occurring fatty acids, but also from various branched-chain higher alcohols. Among the preferred alcohol-ethylene oxide condensation products are those made from alcohols derived from tallow and coconut fatty acids. Most preferred are condensation products of about 4 to about 12 moles of ethylene oxide per mole of an aliphatic alcohol having from 10 to about 18 carbon atoms. An especially preferred compound is middle-cut coconut fatty alcohol condensed with 6 moles of ethylene oxide.

b. Condensates of ethylene oxide with alkylphenols, wherein the phenols are mono- or polyalkylated and the total number of side chain carbon atoms is from about 5 to about 18 carbon atoms. The aromatic nucleus bearing the phenolic hydroxyl can be benzene, naphthalene, or diphenyl, preferably benzene. Specific examples are the condensation products of one mole nonylphenol with 9 to 15 moles of ethylene oxide.

c. Condensates of ethylene oxide with the fatty acid esters, preferably the mono-fatty acid esters of sorbitol and manitol, and, but less preferred, of di- and polysaccharides. Specific examples are the polyoxyethylene sorbitan-monolauric acid esters, having at least 20 ethylene oxide units and the polyoxyethylene derivatives of fatty acid partial esters of hexitol anhydrides generally known under the trade name TWEEN.

d. Polyethynoxy esters or esters obtained by reacting ethylene oxide with carboxylic acids. The acids can be natural fatty acids of fatty acids made from oxidized paraffin wax, or mono- or polyalkylated benzoic and naphthenic acids. Preferred are the aliphatic fatty acids having from 10 to 20 carbon atoms and the alkylbenzoic acids with 5 to 18 carbon atoms in the alkyl groups. Specific examples are tallow oil-ethylene oxide and oleic acid-ethylene oxide condensation products having 9 to 15 ethylene oxide units.

e. Condensation products of fatty acyl alkanolamides of the type $R_{18}$—CO-NH$C_2H_4$OH with ethylene oxide wherein $R_{18}$ is alkyl having from about 7 to 17 carbon atoms. Preferred are condensation products of one mole coconut-CO-NH-$C_2H_4$OH with 5 to 20 moles of ethylene oxide. Specific examples of polyethenoxy alkanolamides of fatty acids are the commercial products, marketed under the trade name ETHOMID.

f. Condensation products of $C_{8-18}$ alkyl, $C_{8-18}$ alkenyl, and $C_{5-18}$ alkylaryl amines and ethylene oxide. A specific and preferred example is the condensation product of one mole of a dedecylamine with 9-12 moles of ethylene oxide. Another specific example has the formula $R_{19}$-CO-NH-$C_6H_4$-N-[ $(OC_2H_4)_6OH]_2$ wherein $R_{19}$ is alkyl having from 11 to 13 carbon atoms.

Another component that can optionally be included in the cleaner composition of this invention is a water-soluble, low molecular weight organic acid, or the water-soluble alkali metal, ammonium, or substituted ammonium salts thereof. Organic acids or their salts are added to enhance the cleaning action of the liquid detergent composition of the present invention and can, in addition, be used as a source of ions to maintain the pH of the composition at a given pH value. Suitable water-soluble, low molecular weight organic acids include, for example, acetic, citric, malic, gluconic, maleic, lactic, tartaric, propionic, butyric, malonic, polymaleic, polyitaconic, glutaric, citraconic, benzene pentacarboxylic, hexacarboxylic, succinic, ethylene diamine tetraacetic, and nitrilotriacetic acids. Partially and completely neutralized salts of the foregoing acids can also be used. Specific examples of suitable, organic acid salts are mono-, di- and trisodium citrate, diammonium citrate, monopotassium tartrate, disodium succinate, and tetrasodium melletate.

The maximum level of the water-soluble organic acids or salts that can be added to the liquid detergent composition of the present invention should not exceed 15 percent by weight of the total weight of the composition, and should preferably be below 10 percent by weight in liquid compositions. Some of the organic acid salts can be replaced by inorganic builder salts. The amount of inorganic builder salts, e.g. sodium phosphates and carbonates, should preferably not exceed the 5 percent by weight in liquid compositions, and should not exceed 15 percent by weight in powdered or granular compositions.

Other suitable ingredients or additional compounds that can optionally be added to improve consumer acceptance of the composition of the present invention are: perfume; dyes; fluorescers; tarnish inhibitors such as benzotriozole or ethylene thio-urea; shine improvers as boric acid or its salts in amounts up to 3 percent by weight; bactericides such as 2-bromo-2-nitro-1,3-propanediol, substituted benziodolium compounds, diphenyl ethers substituted with Cl, Br or -$CF_3$, e.g. 3,4-dichloro-4'-trifluoromethyldiphenyl ether; and organic solvents in amounts up to 15 percent by weight to improve the pourability of the composition and to enhance the compatibility of different components. Examples of the organic solvents are the mono- and dialcohols containing 2 to 8 carbon atoms such as butanol, methyl-propanol-1 and -2, amylol (pentanol), 1,2-, 1,3- and 1,4-butanediol, toluol, benzyl carbinol, ethyleneglycol monobutyl ether, propyleneglycol propyl ether, diethyleneglycol dimethyl ether.

The excellent cleaning and, especially, the fast, regular, persistent drainage performance of the detergent compositions of the present invention are illustrated in the following tests.

EXAMPLE I

Four series, A, B, C, and D, each consisting of five replicates, of dishwashing liquors were prepared, each containing 0.25 percent by weight of a dishwashing composition as defined hereinafter. Also, four series, each consisting of five replicates, of rinsing liquors were prepared. The rinsing liquors were plain tap water. The water of both the washing and rinsing liquors had a water hardness of about 3 millimoles of $CaCO_3$ per liter. Each washing and rinsing liquor was prepared as a bath containing about 5 liters of water. The temperature of all washing liquors was about 45°C at the beginning of the washing cycle and dropped to between 32° and 38°C at the end of the washing cycle. The temperature of the rinsing baths fluctuated between 17° and 19.5°C.

In each replicate of the four series of dishwashing liquors, four soiled, flat dishes (with glazed surfaces), obtained from a cafeteria (80 dishes in all), were washed for 10 seconds, removed from the washing liquor and subsequently rinsed in the respective rinsing baths of each series (3 times successively immersed for 4 seconds, taken out for 2 seconds) and finally removed from the rinsing baths. The dishes were then placed in nearly vertical positions for draining and air-drying.

The rinse water on the dishes washed and rinsed in the washing and rinsing liquors of series A, B and C drained off within 5 seconds. While the dishes washed and rinsed in the washing and rinsing liquors of series A and B were totally dry and spot free after the 5 seconds, the dishes washed and rinsed in the washing and rinsing liquors of series C all showed water spots.

The rinse water on the dishes washed and rinsed in the washing and rinsing liquor of series D only slowly disappeared by evaporation; 10 to 12 minutes were needed to obtain dry dishes.

The washing and rinsing operations as described above, i.e. using four series, A, B, C and D, each consisting of five replicates of dishwashing liquors and four series, each consisting of five replicates, of rinsing liquors, were repeated, but this time continuing the rinsing by immersing the dishes for 4 seconds and removing them for 2 seconds. The rinse water on the first set of dishes washed with composition B but immersed and removed 5 times, did not drain off completely anymore, while the water on the second, third, fourth and fifth set, immersed and removed 6 times and more, did not drain off at all, but disappeared slowly due to evaporation as for treatment D. Even after 20 successive immersions and removals, the water on the dishes washed and rinsed in the washing and rinsing liquors A and C still drained off within 5 seconds leaving the dishes dry and spot-free after treatment A, but spotted after treatment C.

When washing four sets of four dishes each, in washing liquors A, B, C and D respectively, as described above, but rinsing them immediately under running tap water (± 16°C) instead of immersing them in the rinsing liquors, the following results with respect to drainage persistency or spotting were observed:

a. After continued rinsing for a few seconds or more, the water on the dishes washed in the washing liquors A and C drained off within 5 seconds, but while the dishes washed in washing liquor A were dry and spot-free, those washed in washing liquor C were spotted.

b. If the rinsing was done not longer than 10 seconds, the dishes washed in washing liquor B drained off within 5 seconds leaving the dishes dry and spot free. However, if the rinsing lasted longer than 10 seconds, the drainage effect disappeared gradually in time and the rinsing water on the dishes only disappeared slowly due to evaporation. (10 to 12 minutes were needed to obtain dry dishes).

THe dishwashing compositions used in the washing liquors of the series A, B, C, and D of the test were formulated as follows (the figures indicating the percentage by weight of the components present):

| | A | B | C | D |
|---|---|---|---|---|
| Dicoconut dimethyl ammonium bromide | 1 | 1 | 1 | — |
| 3-(N,N-dimethyl-N-dodecylammonio)-2-hydroxypropane-1-sulfonate | 10 | — | 10 | — |
| Polypropylene oxide-polyethylene oxide condensation product (MW about 2,200; ethylene oxide content about 20% by weight) | 8 | 8 | — | — |
| Coconut dimethylamine oxide | 4 | 4 | 4 | — |
| Coconut diethanolamide | 2 | 2 | 2 | — |
| Coconut $(OC_2H_4)_6OH$ | 5 | 5 | 5 | — |
| Tallow $(OC_2H_4)_{11}OH$ | — | — | 8 | — |
| $C_{12}$alkylbenzene-$SO_3Na$ | — | — | — | 20 |
| $C_{12}$alkyl $(OC_2H_4)_3$-$OSO_3Na$ | — | — | — | 10 |
| Water | | balance | | |

EXAMPLE II

A liquid dishwashing composition is prepared by first mixing the quaternary ammonium compound and the betaine, and subsequently the condensation product and the other components, with stirring, to yield a composition containing (in % by weight):

| | |
|---|---|
| Didodecyl dimethyl ammonium bromide | 1.5% |
| 3-(N-coconut-N,N-dimethylammonio)-propionate-1 | 8.0% |
| Polypropylene oxide-polyethylene oxide condensation product (MW about 2,500; ethylene oxide content about 10% by weight) | 10.0% |
| Coconutdimethylamine oxide | 4.0% |
| Coconut diethanol amide | 3.0% |
| Coconut $(OC_2H_4)_6OH$ | 9.0% |
| Water | Balance |

This composition is not only effective for cleaning dishes and glasses when used at 02 percent concentration in washing liquors, but also imparts lustre and shine to the dishes and glasses after they have been either rinsed for a few seconds with running tap water or immersed for about 10 minutes in tap water because of the regular fast drainage of the film of rinse water removing all water hardness. Also, at the end of a long washing cycle, whereby carry-over of surfactant and soil into the rinsing bath may occur, the drainage is still fast and regular removing the contaminants completely and leaving the dishes and glasses spot-free. The composition also has commercially acceptable sudsing and mildness characteristics.

Substantially similar cleaning and drainage performance are obtained when the betaine in Example II is replaced by the same amount of the sultaine 3-[N,N-di(2-hydroxyethyl)-N-tetradecylammonio]-2-hydroxypropane-1-sulfonate.

Replacing the polypropylene oxide-polyethylene oxide condensation product of Example II with one having a molecular weight of about 3,500 and an ethylene oxide content of about 18 percent by weight yields a product with approximately the same cleaning and rinsing performance. Replacing the polypropylene oxide-polyethylene oxide condensation product of Example II by the same amount of a polyethylene glycol having a molecular weight of about 2,500 yields a composition with acceptable cleaning but irregular drainage, leaving spots on dishes and glasses.

The following examples are illustrations of compositions of the present invention. All figures given indicate percentages by weight.

EXAMPLE III

| | |
|---|---|
| Ditetradecyldiethylammonium chloride | 2% |
| Dodecyldimethylammoniopropane sulfonate | 12% |
| Polypropylene oxide-polyethylene oxide condensation product (MW about 2,200; ethylene oxide content about 20% by weight) | 14% |
| Coconutdimethylamine oxide | 4% |
| Water | Balance |

EXAMPLE IV

| | |
|---|---|
| Didecyldimethylammonium chloride | 1% |
| 2-(N,N-dimethyl-N-dodecylammonio)-ethane-1-sulfonate | 5% |
| Polypropylene oxide-polyethylene oxide condensation product (MW about 1,500; ethylene oxide content about 20% by weight) | 5% |
| Dodecyl $(OC_2H_4)_6OH$ | 10% |
| Citric acid | 5% |
| Water | Balance |

EXAMPLE V

| | |
|---|---|
| Didecyldimethylammonium chloride | 0.5% |
| 3-(N,N-dimethyl-N-dodecylammonio)-propane-1-sulfonate | 5.0% |
| Polypropylene oxide-polyethylene oxide condensation product (MW about 1,500; ethylene oxide content about 10% by weight) | 5.0% |
| Dodecyl $(OC_2H_4)_6OH$ | 10.0% |
| Triethanolamine | 10.0% |
| Sodium citrate | 5.0% |
| Water | Balance |

EXAMPLE VI

| | |
|---|---|
| Nonylbenzyldimethylhydroxypropyl ammonium chloride | 1% |
| 3-(N,N-dimethyl-N-nonylbenzylammonio)-propane-1-sulfonate | 10% |
| Polypropylene oxide-polyethylene oxide condensation product (MW about 3,500; ethylene oxide content about 10% by weight) | 10% |
| Coconut dimethylamine oxide | 5% |
| Coconut diethanol amide | 2% |
| Water | Balance |

EXAMPLE VII

| | |
|---|---|
| Ditallowdimethylammonium chloride | 1% |
| 3-(N,N-dimethyl-N-dodecylammonio)-2-hydroxy-propane-1-sulfonate | 15% |
| Polypropylene oxide-polyethylene oxide Condensation product (MW about 5,000; | |

-continued

| | |
|---|---|
| ethylene oxide content about 20% by weight) | 10% |
| Condensation product of the one mole of tallow alcohol and about 11 moles of ethylene oxide | 5% |
| Sodium tripolyphosphate | 8% |
| Sodium sulfate | 57% |
| Water | 4% |

EXAMPLE VIII

| | |
|---|---|
| Didodecyldiethylammonium chloride | 4% |
| 3-(N,N-dimethyl-N-dodecylammonio)-2-hydroxy-propane-1-sulfonate | 16% |
| Polypropylene oxide-polyethylene oxide condensation product (MW about 2,500; ethylene oxide content about 10% by weight) | 20% |
| $C_{16}H_{33}O(C_2H_4O)_{11}H$ | 5% |
| Sodium tripolyphosphate | 15% |
| Sodium silicate | 5% |
| Sodium sulfate | 30% |
| Water and perfume | 5% |

EXAMPLE IX

| | |
|---|---|
| Tetramethyl-di-(octoxy-β-hydroxypropyl)-β-hydroxypropylene-diammonium chloride | 1.5% |
| Polypropylene oxide-polyethylene oxide condensation product (MW about 3,500; ethylene oxide content about 22% by weight) | 6.0% |
| 3-[N,N-di(2-hydroxyethyl)-N-octadecyl]-2-hydroxy-propionate-1 | 10.0% |
| Citric acid | 3.0% |
| Sodium silicate | 2.0% |
| Dodecyldimethylamine oxide | 8.0% |
| Ethanol | 8.0% |
| Water | Balance |

What is claimed is:

1. A dishwashing detergent composition especially adapted for washing and imparting shine to glassware, china and articles with vitreous surfaces, comprising:

A. from about 1 to about 5 percent by weight of the total composition of a water-soluble quaternary ammonium compounds of the general formula:

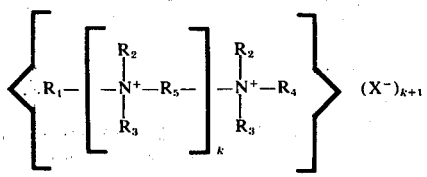

wherein $R_1$ and $R_4$ are each alkyl radicals having from 12 to 16 carbon atoms;

$R_2$ and $R_3$ are each radicals selected from the group consisting of methyl, ethyl, and hydroxyethyl;

$R_5$ is a radical selected from the group consisting of ethylene, propylene and hydroxypropylene;

$X^-$ is an anion selected from the group consisting of chloride and bromide or mixtures thereof; and k is 0;

B. from about 4 to about 20 percent by weight of a nonionic surface-active polypropylene oxide-polyethylene oxide condensation product having a molecular weight of from 500 to about 10,000, wherein the ethylene oxide content is from about 10 to about 30 percent by weight of said condensation product; and C. from about 5 to about 20 percent by weight of a water-soluble compound of the general formula:

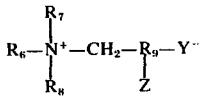

wherein $R_6$ is a radical selected from the group consisting of alkyl radicals having from 12 to 16 carbon atoms;

$R_7$ and $R_8$ are each radicals selected from the group consisting of methyl, ethyl, and hydroxyethyl;

$Y^-$ is $-SO_3$; and $R_9$-Z is a $-CH(OH)-CH_2-$ radical, whereby the weight ratio of (A)/(B) is from about 1:4 to about 1:10, and the weight ratio of (A)/(C) is from about 1:5 to about 1:20.

2. The composition of claim 1 which contains up to about 15 percent by weight of a water-soluble compound selected from the group consisting of organic acids and the sodium, potassium, ammonium, and substitute ammonium salts thereof.

3. The composition of claim 2 wherein said acid or salt thereof is present at from about 3 to about 10 percent by weight.

4. The composition of claim 1 which contains from about 10 to about 25 percent by weight of a ternary mixture of compounds (A), (B), and (C) and which is in liquid form.

5. The composition of claim 1 which contains up to 75 percent by weight of a neutral carrier selected from the group consisting of sodium sulfate, potassium sulfate, sodium chloride, potassium chloride, and sodium silicate.

6. The composition of claim 5 wherein said neutral carrier is present at from about 15 to about 50 percent by weight.

7. The composition of claim 1 which contains up to about 10 percent by weight of an inorganic builder salt.

8. The composition of claim 7 wherein said inorganic builder salt is present at from about 2 to about 5 percent by weight.

* * * * *